US009841020B2

(12) United States Patent
Ammon et al.

(10) Patent No.: US 9,841,020 B2
(45) Date of Patent: Dec. 12, 2017

(54) HYDRAULIC FEED DEVICE AND HYDRAULIC SYSTEM

(71) Applicant: Mahle International GmbH, Stuttgart (DE)

(72) Inventors: Edgar Ammon, Remshalden (DE); Ruediger Knauss, Kernen i. R. (DE); Mark Tepler, Schleusingen (DE); Christian Richter, Schleusingen (DE); Robert Ristovski, Schorndorf (DE)

(73) Assignee: Mahle International GmbH (DE)

( * ) Notice: Subject to any disclaimer, the term of this patent is extended or adjusted under 35 U.S.C. 154(b) by 339 days.

(21) Appl. No.: 13/926,704

(22) Filed: Jun. 25, 2013

(65) Prior Publication Data

US 2013/0343940 A1 Dec. 26, 2013

(30) Foreign Application Priority Data

Jun. 26, 2012 (DE) ..... 10 2012 210 899

(51) Int. Cl.
*F04B 49/00* (2006.01)
*F04C 14/22* (2006.01)
*F04C 2/332* (2006.01)

(52) U.S. Cl.
CPC ..... *F04C 14/22* (2013.01); *F04C 2/332* (2013.01); *F04C 14/226* (2013.01); (Continued)

(58) Field of Classification Search
USPC ..... 418/30, 31; 417/220
See application file for complete search history.

(56) References Cited

U.S. PATENT DOCUMENTS 3,463,283 A * 8/1969 Stow ..... 192/85.61
7,351,175 B2 * 4/2008 Kraxner et al. ..... 475/127
(Continued)

FOREIGN PATENT DOCUMENTS

DE 10352254 B3 6/2005
DE 102004008611 A1 9/2005
(Continued)

OTHER PUBLICATIONS

English abstract for DE-102004008611.
English abstract for DE-102010041550.
English abstract for DE-102006061326.

*Primary Examiner* — Charles Freay
(74) *Attorney, Agent, or Firm* — Fishman Stewart PLLC

(57) ABSTRACT

A hydraulic feed device may include a pendulum-slide cell pump having an internal rotor drivingly connected to an external rotor via pendulum slides. A hydraulic positioning device may have a positioning element for changing an eccentricity between the internal rotor and the external rotor. The positioning element may be preloaded by a spring device for setting a maximum eccentricity. The positioning device may have a first pressure adjusting and a second pressure adjusting chamber for adjusting the positioning element. The first pressure adjusting chamber may be permanently hydraulically connected to a pressure side of the pendulum-slide cell pump and configured to hydraulically counteract the spring device. The second pressure adjusting chamber may be controlled via a control valve and hydraulically connected to the pressure side of the pendulum-slide cell pump and configured to hydraulically counteract the spring device.

19 Claims, 2 Drawing Sheets

(52) U.S. Cl.
CPC .... *F04C 2210/206* (2013.01); *F04C 2240/81* (2013.01); *F04C 2240/811* (2013.01)

(56) References Cited

U.S. PATENT DOCUMENTS

| | | | | |
|---|---|---|---|---|
| 7,794,217 | B2 * | 9/2010 | Williamson et al. | 418/26 |
| 8,047,872 | B2 | 11/2011 | Burris et al. | |
| 8,182,238 | B2 * | 5/2012 | Frait | 417/220 |
| 8,684,702 | B2 * | 4/2014 | Watanabe et al. | 417/220 |
| 8,992,184 | B2 * | 3/2015 | Wagner | 417/220 |
| 2001/0009881 | A1 * | 7/2001 | Albs et al. | 475/127 |
| 2003/0031567 | A1 * | 2/2003 | Hunter et al. | 417/220 |
| 2004/0000142 | A1 * | 1/2004 | Nunomura | F16D 31/02 60/445 |
| 2005/0050886 | A1 * | 3/2005 | Bauer | B60G 17/0152 60/413 |
| 2007/0224067 | A1 * | 9/2007 | Arnold et al. | 418/26 |

FOREIGN PATENT DOCUMENTS

| | | | |
|---|---|---|---|
| DE | 102006061326 | A1 | 7/2008 |
| DE | 112007001131 | T5 | 4/2009 |
| DE | 102010041550 | A1 | 3/2012 |
| WO | WO 2010/142611 | * | 12/2010 |

* cited by examiner

HYDRAULIC FEED DEVICE AND HYDRAULIC SYSTEM

CROSS REFERENCE TO RELATED APPLICATIONS

This application claims priority to German Patent application 10 2012 210 899.8 filed Jun. 26, 2012, which is hereby incorporated by reference in its entirety.

TECHNICAL FIELD

The present invention relates to a hydraulic feed device, in particular an oil feed device, preferably for an internal combustion engine, with the features of the preamble of the claim 1. The invention further relates to a hydraulic system provided with such a hydraulic feed device, preferably for an internal combustion engine, in particular of a motor vehicle.

BACKGROUND

From DE 10 2010 041 550 A1, a hydraulic feed device is known which has a pendulum-slide cell pump in which an internal rotor is drivingly connected to an external rotor via pendulum slides. Furthermore, the known hydraulic feed device is provided with a hydraulic positioning device for changing eccentricity between internal rotor and external rotor, which has a positioning element for adjusting the eccentricity. Furthermore, the positioning element is preloaded by means of a spring device for setting a maximum eccentricity.

In the case of a pendulum-slide cell pump, the feed rate, besides the speed, is also determined through the eccentricity between the internal rotor and the external rotor. The greater the eccentricity, the higher the feed rate is. In contrast, if the internal rotor and the external rotor are arranged concentrically, the feed rate is reduced to the value "0", regardless of the speed.

Such hydraulic feed devices can be used in motor vehicles so as to drive a hydraulic working means, preferably oil, in a hydraulic system of the vehicle. Of particular interest are combined hydraulic systems comprising at least two different hydraulic circuits that are assigned to different functions. For example, a primary circuit for actuating a hydraulically actuatable clutch can be coupled with a secondary circuit for supplying lubrication points with oil. The different hydraulic circuits have different requirements in terms of the necessary hydraulic pressure. While lubricating oil supply only needs a constant, comparatively low oil pressure, a clutch may require a varying oil pressure. For example, for shifting the clutch, the oil pressure can be temporarily raised to a high level.

For reducing costs it is desirable to use only a single common hydraulic feed device in such a combined hydraulic system so as to provide both hydraulic circuits with the required hydraulic pressure, wherein the different pressure requirements are to be considered. For this purpose it is principally possible to equip the hydraulic system with a comparatively complex arrangement of control and regulating valves in order to be able to implement the desired hydraulic pressures in both hydraulic circuits. However, the costs for this are comparatively high.

SUMMARY

The present invention is concerned with the problem of providing for a hydraulic system of the above-described kind an improved embodiment that is characterized by a comparatively simple structure. Moreover, high functional reliability and/or operational reliability are aimed at.

This problem is solved according to the invention by the subject matter of the independent claim. Advantageous embodiments are subject matter of the dependent claims.

The invention is based on the general idea to equip the hydraulic positioning device with a first pressure adjusting chamber and a second pressure adjusting chamber for displacing the positioning element against the preload direction of the spring device, wherein the first pressure adjusting chamber is hydraulically connected in an uncontrolled manner to the pressure side of the pendulum-slide cell pump while the second pressure adjusting chamber is hydraulically connected to the pressure side of the pendulum-slide cell pump and is controlled via a control valve. Through this construction, the first pressure adjusting chamber acts as a pressure limiter. If the pressure on the pressure side of the pendulum-slide exceeds a predetermined pressure, the pressure correlating therewith effects in the first pressure adjusting chamber an adjustment of the positioning element against the preload direction of the spring device, thus in the direction of reduced eccentricity. By reducing the eccentricity, the feed rate and thus in particular the pressure generation of the pendulum-slide cell pump is reduced accordingly, by which means the desired effect as a pressure limiter is implemented. Furthermore, the first pressure adjusting chamber functions independent of the second pressure adjusting chamber so that even in the event of a failure of the control valve, the pressure limiting function is still maintained. To this extent, using two separate pressure adjusting chambers, one of which is coupled permanently and uncontrolled to the pressure side of the pendulum-slide cell pump, enables a functionally reliable operation, even in the case that the control valve fails. To this extent, a fail-safe principle can be implemented.

The pressure in the second pressure adjusting chamber can be regulated by means of the control valve. Hereby, the second pressure adjusting chamber can be used for adjusting the pressure on the pressure side of the pendulum-slide cell pump. Since both pressure adjusting chambers drive the positioning element in the same direction, namely against the preload direction of the spring device, the adjustable driving forces generated in the second pressure adjusting chamber are added to the non-adjustable, permanently acting driving forces which act in the first pressure adjusting chamber.

In particular, according to a preferred embodiment, the first and the second pressure adjusting chambers can be designed in such a manner that in the case that in both pressure adjusting chambers there is a pressure below a predetermined maximum pressure, they are able to displace the positioning element against the spring force of the spring device for reducing the eccentricity. Thus, as long as the pressure on the pressure side of the pendulum-slide cell pump does not exceed the predetermined maximum pressure, the feed rate or pressure generation of the pendulum-slide cell pump can be varied, in particular reduced, by correspondingly activating the control valve.

According to another advantageous embodiment, the first pressure adjusting chamber can be designed in such a manner that even in the case that the second pressure adjusting chamber is unpressurized, the first pressure adjusting chamber displaces the positioning element against the spring force of the spring device for reducing the eccentricity as soon as the pressure prevailing on the pressure side of the pendulum-slide cell pump exceeds a predetermined maximum pressure. For example, the second pressure adjusting chamber can be connected via the control valve to an unpressurized hydraulic reservoir. Even in this case, the first pressure chamber ensures that a predetermined maximum pressure on the pressure side of the pendulum-slide cell pump is not exceeded so that the first pressure adjusting chamber can act as a pressure limiter completely independent of the second pressure adjusting chamber.

The spring device can be arranged within the positioning device in a counter-pressure chamber that is permanently hydraulically connected, thus uncontrolled, to a suction side of the pendulum-slide cell pump. In this manner, the maximum pressure to be monitored can be specified in a comparatively accurate absolute manner by appropriately designing the first pressure adjusting chamber and the spring device.

According to an advantageous embodiment of the invention, the control valve can be configured as a proportional valve. A proportional valve quasi enables any intermediate positions between an open position and a closed position. While in the open position the second pressure adjusting chamber is fluidically connected to the pressure side of the pendulum-slide cell pump, this connection is blocked in the closed position. The proportional valve now enables any desired intermediate positions in order to transmit the pressure of the pressure side of the pendulum-slide cell pump in a more or less throttled manner to the second pressure adjusting chamber. It is therefore possible in the second pressure adjusting chamber to set virtually any pressures that are within a pressure interval that is limited toward the lower limit by the pressure on the suction side of the pendulum-slide cell pump, and is limited toward the upper limit by the pressure on the pressure side of the pendulum-slide cell pump.

According to another advantageous embodiment, the control valve can be configured as a 3-port/2-way directional control valve, the first port of which is hydraulically connected to the pressure side of the pendulum-slide cell pump, the second port of which is hydraulically connected to the second pressure adjusting chamber, and the third port of which is hydraulically connected to a relatively unpressurized, in particular atmospheric hydraulic reservoir. Thus, in a first end position (open position), the control valve can couple the first port to the second port so that the pressure side of the pendulum-slide cell pump is connected to the second pressure adjusting chamber. However, in a second end position (closed position), the second port is connected to the third port so that the second pressure adjusting chamber is connected to the hydraulic reservoir. Through the configuration of the 3-port/2-way directional control valve as a proportional valve, virtually any intermediate positions can be implemented between the two end positions so that the pressure in the second pressure adjusting chamber can be adjusted as desired between the pressure on the pressure side and the pressure in the hydraulic reservoir. In the unpressurized or atmospheric hydraulic reservoir, there is ambient pressure, thus atmospheric pressure, for example.

According to an advantageous embodiment, the control valve can comprise an electric actuator that can be activated by means of electrical control signals. By means of such an actuator, the control valve can be activated relatively precisely according to the respective pressure requirements. In particular when using a proportional valve, the desired pressures in the second pressure adjusting chamber can be adjusted comparatively accurately in this manner.

According to another advantageous embodiment, the positioning element can be formed by a stator in which the rotor is rotatably arranged and which is pivotably adjustable about a pivot axis extending parallel and eccentric to the rotational axis of the internal rotor in a housing of the positioning device, wherein the rotational axis of the internal rotor is arranged stationarily or locally fixed with regard to the housing. For example, a shaft extending coaxial to the rotational axis of the internal rotor can be fastened to the housing so that the internal rotor is rotatably mounted on this shaft. Alternatively, this shaft can also be rotatably mounted on the housing, wherein in this case, the internal rotor is arranged rotationally fixed on this shaft. The configuration of the positioning element as a stator in which the external rotor is mounted to be pivotable relative to the internal rotor and eccentric to the rotational axis of the internal rotor results in an extremely compact construction for the positioning device.

Due to this construction, the positioning device is structurally integrated in the pendulum-slide cell pump since the stator of the pendulum-slide cell pump, on the one hand, mounts the external rotor of the pendulum-slide cell pump and, on the other, forms the positioning element of the positioning device.

According to an advantageous refinement, the first pressure adjusting chamber can be arranged proximal to the pivot axis in the housing. Hereby, the pressure forces that can be generated in the first pressure adjusting chamber have a comparatively short lever arm for driving the positioning element/stator. Thus, comparatively high maximum pressures can be implemented which can be reduced by means of the first pressure adjusting chamber.

Additionally or alternatively, the second pressure adjusting chamber can be arranged distal to the pivot axis in the housing. Through this measure, the pressure forces that can be generated in the second pressure adjusting chamber have a comparatively long lever arm for driving the positioning element. Thus, even lower pressure forces can also be utilized for generating significant actuating forces for adjusting the positioning element/stator.

Additionally or alternatively, the spring device can be arranged distal to the pivot axis in the housing. Through this measure, the spring device too has a comparatively long lever arm. However, through this, a comparatively great spring travel for the spring device is implemented at the same time so that, for example, sufficient installation space can be implemented for a linear spring characteristic.

According to another advantageous refinement, the first pressure adjusting chamber can be directly bounded by a first inner wall portion of the housing and a first outer wall portion of the stator. Additionally or alternatively, it can be provided that the second pressure adjusting chamber is directly bounded by a second inner wall portion of the housing and a second outer wall portion of the stator. This measure results in a structure for the hydraulic feed device which can be implemented in a particularly simple manner and in which the positioning device is integrated in the housing of the pendulum-slide cell pump.

In another advantageous embodiment, the spring device can comprise at least one compression spring, for example a helical compression spring, via which the stator is supported by the housing. This too facilitates a compact embodiment that can be implemented in a simple manner.

A hydraulic system according to the invention that is preferably used in a motor vehicle comprises a primary hydraulic circuit, a secondary hydraulic circuit and a hydraulic feed device of the above-described kind for hydraulic medium supply to the two hydraulic circuits. If the hydraulic system has only one of these two circuits, accordingly, only a single hydraulic feed device is provided. The primary circuit, for example, has variable hydraulic pressure needs wherein, in particular temporarily, comparatively high pressures can also be required. In contrast to this, the secondary circuit can have comparatively constant hydraulic pressure needs on a comparatively low pressure level. For example, the primary circuit can serve for controlling a clutch while the secondary circuit can serve for cooling and/or lubricating the clutch and/or a transmission and/or an internal combustion engine and/or other components of the vehicle. Through suitably actuating the control valve, the pressure that is provided on the pressure side by the pendulum-side cell pump can be varied via the second pressure adjusting chamber, for example, to temporarily provide high pressure. By means of the second pressure adjusting chamber it can be ensured that the predetermined maximum pressure is not exceeded in the primary circuit or in the secondary circuit.

According to an advantageous embodiment, a control device can be provided for generating control signals which correlate with a hydraulic pressure demand of the primary circuit, wherein the control device is coupled to the control valve in such a manner that the control device actuates the control valve by means of the control signals. In this manner, the feed rate or the feed pressure of the pendulum-slide cell pump can be adapted to the actual demand of the primary circuit.

In an advantageous refinement, the control device can be coupled with a pressure sensor system that measures the hydraulic pressure provided by the hydraulic feed device. In this manner, a closed loop control can be created so as to be able to adjust or control the desired hydraulic pressure demand as accurately as possible.

In another advantageous embodiment, the secondary circuit can be connected to the hydraulic feed device via a volume flow control valve. The volume flow control valve enables adjusting a predetermined volume flow in the secondary circuit, independent of the pressure on the pressure side of the pendulum-slide cell pump.

For a use according to the invention of a hydraulic system of the above-described kind, the hydraulic system can serve for supply of a vehicle transmission, wherein the primary circuit of the hydraulic system supplies a hydraulic actuating device for actuating a clutch of the transmission with oil on a relatively high pressure level, while the secondary circuit of the hydraulic system supplies the lubrication points of the transmission with oil on a relatively low pressure level. The adjectives "high" and "low" are to be understood in relation to one another so that the high pressure level lies above the low pressure level.

A vehicle transmission according to the invention is provided with a hydraulic system of the above-described kind.

Further important features and advantages of the invention arise from the sub-claims, from the drawings, and from the associated description of the figures based on the drawings.

It is to be understood that the above-mentioned features and the features still to be explained hereinafter are usable not only in the respective mentioned combination but also in other combinations or alone without departing from the context of the present invention.

Preferred exemplary embodiments of the invention are illustrated in the drawings and are explained in more detail in the following description, wherein identical reference numbers refer to identical, or similar, or functionally identical components.

BRIEF DESCRIPTION OF THE DRAWINGS

In the figures, schematically.

DETAILED DESCRIPTION

Figure 1:
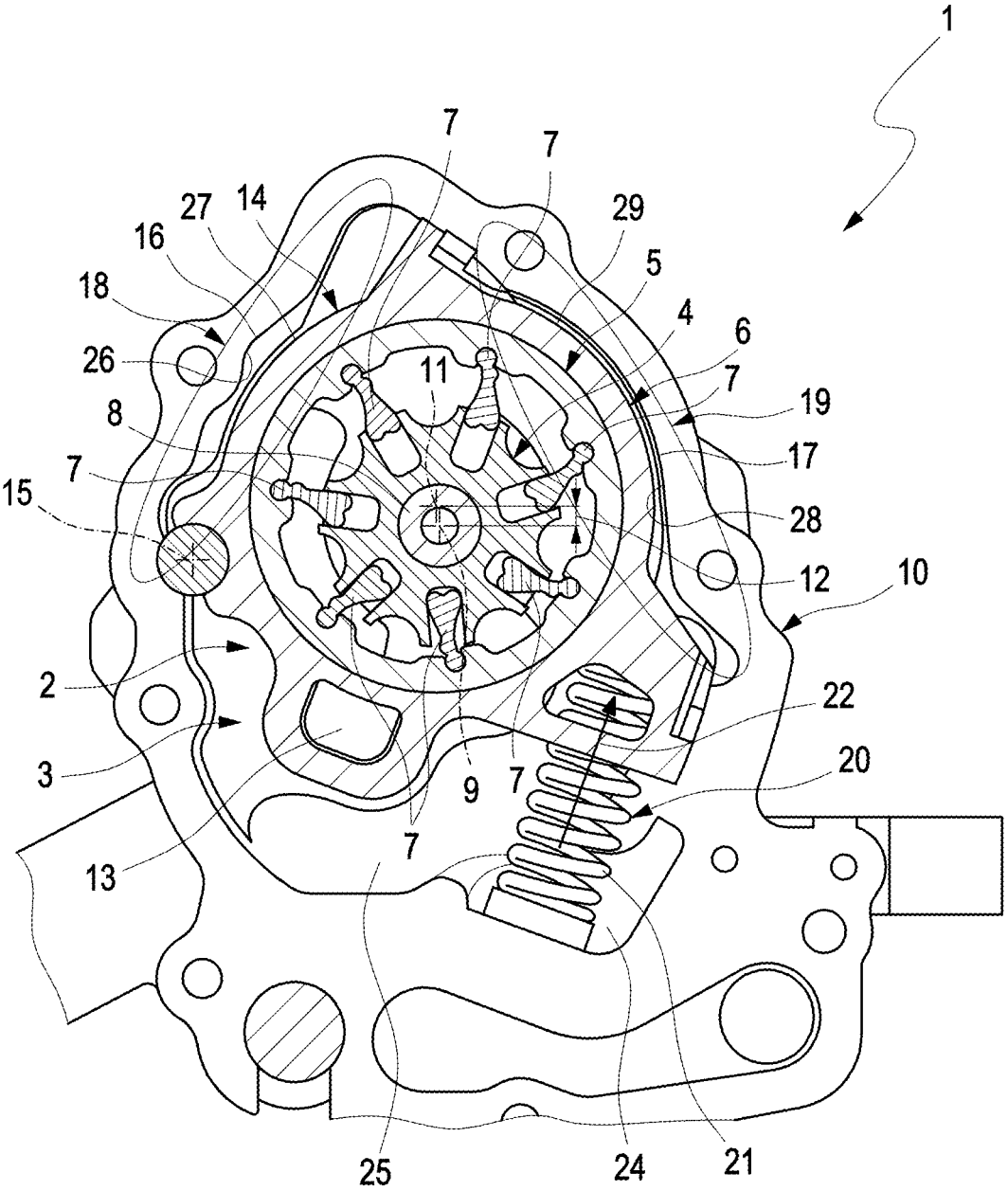
FIG. 1 shows a sectional view of a hydraulic feed device.

According to FIG. 1, a hydraulic feed device 1, which preferably can be an oil feed device, comprises a pendulum-slide cell pump 2 and a hydraulic positioning device 3. The pendulum-slide cell pump 2 comprises an internal rotor 4, an external rotor 5 and a stator 6. The external rotor 5 is rotatably mounted in the stator 6. Furthermore, the external rotor 5 is drivingly connected to the internal rotor 4 via a plurality of pendulum slides 7. Furthermore, the internal rotor 4 is arranged concentric to a shaft 8 that extends coaxial to a rotational axis 9. The rotational axis 9 and/or the shaft 8 are arranged fixed or stationary with regard to a housing 10 of the device 1. Here, the shaft 8 can be fastened to the housing 10, wherein in this case, the internal rotor 4 is mounted rotatably on the shaft 8. As an alternative, the internal rotor 4 can also be connected to the shaft 8 in a rotationally fixed manner; in this case, the shaft 8 is mounted rotatably in the housing 10. In both cases, the rotational axis 9 is stationary or fixed with regard to the housing 10. However, it is preferred that the shaft 8 is rotatably mounted in the housing 10, by which means it is in particular possible to use the shaft 8 as drive shaft for driving the internal rotor 4. However, another embodiment is principally also conceivable. For example, the external rotor 5 and the stator 6 can interact like an electric motor, for which purpose suitable electromagnetic coils, which are not shown here, can be arranged on the stator 6, while permanent magnets (likewise not shown) can be arranged on the external rotor 5.

The external rotor 5 has a longitudinal centre axis 11 which, in the state of the FIG. 1, is arranged eccentric to the rotational axis 9, which is arranged concentric to the internal rotor 4 and, accordingly, has an eccentricity 12. In such a pendulum-slide cell pump 2, the amount of this eccentricity 12 determines the feed rate or the achievable pressure on a pressure side 13 of the pendulum-slide cell pump 2. The greater the eccentricity 12, the higher the achievable pressure.

With the aid of the hydraulic positioning device 3, it is now possible to adjust, thus change, the eccentricity 12 between the internal rotor 4 and the external rotor 5 so as to be able to vary or adjust on the pressure side 13 the pressure that can be generated with the aid of the pendulum-slide cell pump 2. For this purpose, the positioning device 3 comprises a positioning element 14 with the aid of which the relative position between external rotor 5 and internal rotor 4 can be changed. In detail, the position of the external rotor 5 relative to the housing 10 can be changed with the aid of the positioning element 14. Since with regard to the housing 10, the internal rotor 4 is arranged stationarily via the shaft 8, changing the relative position between the external rotor 5 and the housing 10 results in a change of the relative position between the external rotor 5 and the internal rotor 4, by which means the eccentricity 12 changes.

In the preferred embodiment illustrated in FIG. 1, the positioning element 14 is substantially formed by the stator 6 of the pendulum-slide cell pump 2. By changing the relative position of the stator 6 in the housing 10, the external rotor 5 mounted therein is inevitably also displaced relative to the housing 10. The stator 6 and/or the positioning element 14 are mounted on the housing 10 so as to be pivotably adjustable about a pivot axis 15. The pivot axis 15 extends parallel and eccentric to the rotational axis 9 of the internal rotor 4.

The positioning device 3 also comprises a first pressure adjusting chamber 16 and a second pressure adjusting chamber 17. Both pressure adjusting chambers 16, 17 serve for displacing the positioning element 14. In FIG. 1, a first chamber region 18, in which the first pressure adjusting chamber 16 is formed, is indicated by an ellipse. Furthermore, a second chamber region 19, in which the second pressure adjusting chamber 17 is formed, is indicated in FIG. 1 by a further ellipse. The positioning device 3 further comprises a spring device 20 which is supported one the one side on the housing 10 and on the other side on the stator 6 thereby preloading the stator 6 into a position in which a maximum eccentricity 12 is given.

In the example shown in FIG. 1, the spring device 20 generates a compressive force. Furthermore, the spring device 20 is exemplary implemented here with a helical compression spring 21.

The first pressure adjusting chamber 16 is hydraulically connected to the pressure side 13 of the pendulum-slide cell pump 2 in a permanent and uncontrolled manner. Furthermore, the first pressure adjusting chamber 16 is arranged such that the pressure forces prevailing therein drive the positioning element 14 against a spring force 22 which is indicated in FIG. 1 by an arrow. The second pressure adjusting chamber 17 is also hydraulically connected to the pressure side 13 of the pendulum-slide cell pump 2; however, this hydraulic connection is controlled by means of a control valve 23 that is illustrated in the FIGS. 2 and 3. Here too, the arrangement of the second pressure adjusting chamber 17 takes place such that the pressure prevailing therein counteracts the spring force 22 of the spring device 20.

Designing the two pressure adjusting chambers 16, 17 is advantageously carried out such that in the case that a pressure prevailing in both pressure adjusting chambers 16, 17 lies below a predetermined maximum pressure, the two pressure adjusting chambers 16, 17 displace the positioning element 14 against the spring force 22 for reducing the eccentricity 12. Furthermore, the first pressure adjusting chamber 16 is advantageously designed such that in the case that the second pressure adjusting chamber 17 is quasi unpressurized, it displaces the positioning element 14 against the spring force 22 of the spring device 20 for reducing the eccentricity as soon as the pressure prevailing on the pressure side 13 exceeds the predetermined maximum pressure. In other words, as soon as the pressure on the pressure side 13 exceeds the predetermined maximum pressure, the pressure forces thereby generated in the first pressure adjusting chamber 16 are sufficient for displacing the positioning element 14 against the spring device 20 for reducing the eccentricity 12. In contrast, if the pressure on the pressure side 13 is below the maximum pressure, the pressure forces generated in the first pressure adjusting chamber 16 are not sufficient to displace the positioning element 14 against the spring device 20. However, in the case of pressures on the pressure side 13 below the maximum pressure, displacing the positioning element 14 against the spring device 20 is still possible if in addition a corresponding pressure is built up in the second pressure adjusting chamber 17 via the control valve 23. Thus, with the aid of the first pressure adjusting chamber 16, the function of a pressure limiter can be implemented while with the aide of the second pressure adjusting chamber 17, the function of a pressure adjusting device can be implemented.

In the example of the FIG. 1, the spring device 20 is arranged in a counter pressure chamber 24 which is permanently, thus uncontrolled, hydraulically coupled to a suction side 25 of the pendulum-slide cell pump 2.

In the embodiment shown in FIG. 1, the first pressure adjusting chamber 16 is arranged proximal to the pivot axis 15 in the housing 10. In contrast, the second pressure adjusting chamber 17 and the spring device 20 and/or the counter pressure chamber 24 are arranged distal to the pivot axis 15 in the housing 10. Furthermore, in the embodiment shown here it is provided that the first pressure adjusting chamber 16 is directly bounded by a first inner wall portion 26 of the housing 10 and a first outer wall portion 27 of the stator 6. Furthermore, the second pressure adjusting chamber 17 is directly bounded by a second inner wall portion 28 of the housing 10 and a second outer wall portion 29 of the stator 6. The compression spring 21 used for implementing the spring device 20 supports the stator 6 via the housing 10.

Figure 2:
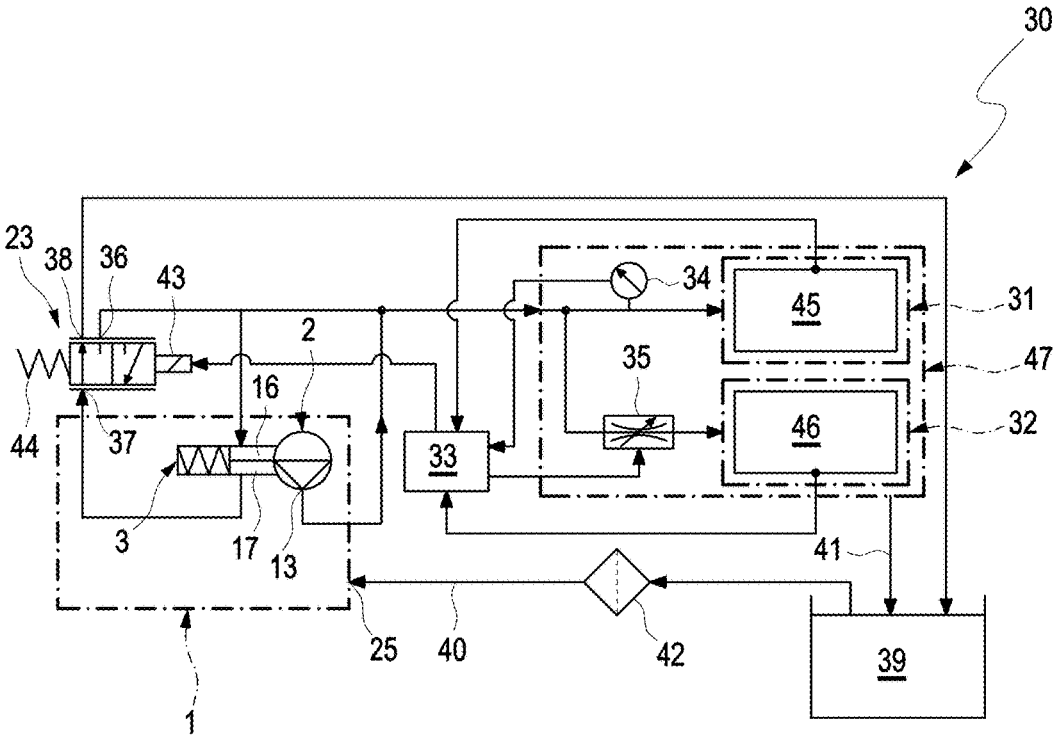
FIGS. 2 and 3 show circuit-diagram-like schematic diagrams of a hydraulic system in different operating states.
Figure 3:
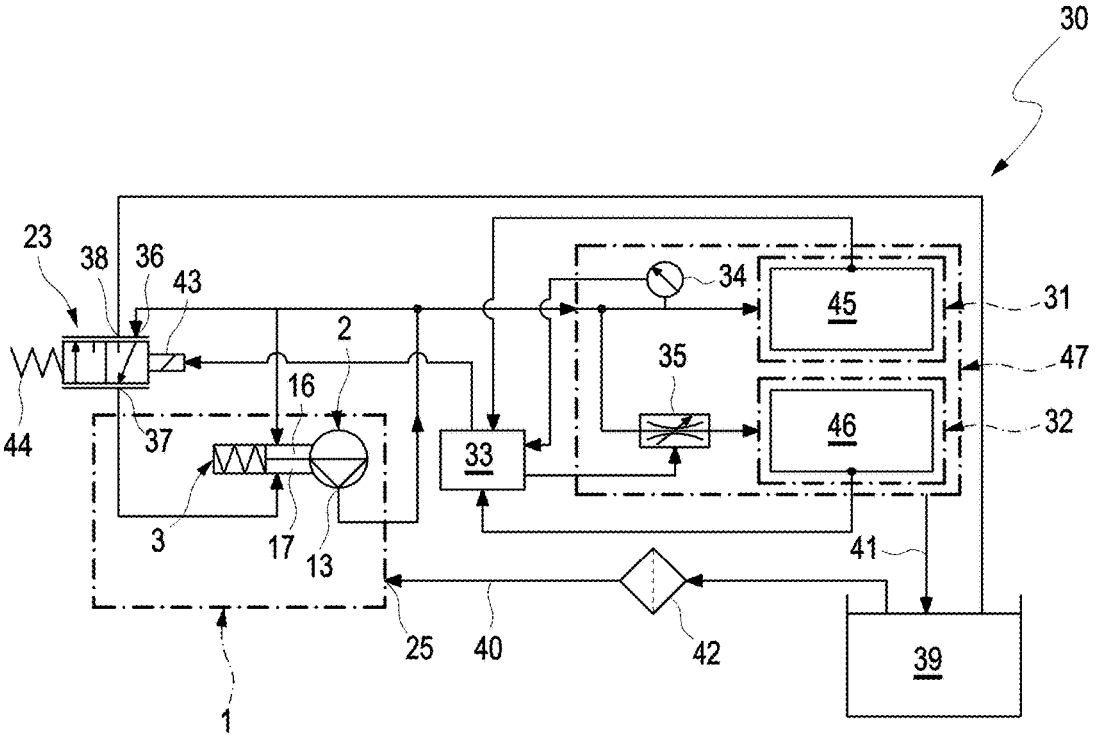

According to the FIGS. 2 and 3, a hydraulic system 30, as it can be implemented, for example, in a motor vehicle, comprises a primary hydraulic circuit 31 and secondary hydraulic circuit 32 which are jointly connected to a hydraulic feed device 1 of the above-described kind. The primary circuit 31 can be used, for example, for shifting a clutch. The primary circuit 31 is characterized by a variable hydraulic pressure demand, wherein in particular for shifting the clutch, a comparatively high hydraulic pressure is temporarily needed. In contrast to this, the secondary circuit 32 is characterized by a substantially constant hydraulic pressure demand which ranges on a comparatively low pressure level. For example, the secondary circuit can be a cooling and/or lubricating oil circuit. The hydraulic system 30 is also equipped with a control device 33 which is suitably connected to the control units 45 and 46, respectively, of the two circuits 31, 32 of the hydraulic system 30, and to the control valve 23. Furthermore, the control device 33 is coupled to a pressure sensor system 34, by means of which the hydraulic pressure provided on the pressure side by the hydraulic feed device 1 can be measured. Moreover, the secondary circuit 32 is connected to the hydraulic feed device 1 via a volume flow control valve 35. The example shown is a controllable volume flow control valve 35 that can be actuated or activated by means of the control device 33. The sensor system 34 and also the volume flow control valve 35 are situated in a hydraulic periphery 47 of the hydraulic system 30.

Depending on the hydraulic pressure demand of the primary circuit 31, the control device 33 can generate control signals correlating with said demand so as to be able to suitably activate the control valve 23 and to implement the desired hydraulic pressure demand. Via the sensor system 34, pressure control can be implemented.

The control valve 23 in the embodiments shown here is a proportional valve. Furthermore, the control valve 23 is a 3-port/2-way directional control valve. The control valve 23 thus has a first port 36 that is hydraulically connected to the pressure side 13 of the pendulum-slide cell pump 2. Furthermore, a second port 37 of the control valve 23 is hydraulically connected to the second pressure adjusting chamber 17. A third port 38 of the control valve 23 is hydraulically connected to a hydraulic reservoir 39 that is comparatively unpressurized or has ambient pressure. A suction line 40 runs from the hydraulic reservoir 39 to the suction side 25 of the pendulum-slide cell pump 2. Furthermore, a return line 41 of the primary circuit 31 and the secondary circuit 32 runs back to the reservoir 39. A hydraulic medium filter 42 can be arranged in the suction line 40.

The control valve 23 has an electric actuator 43 by which means it can be activated via the control device 33 with the aid of electrical control signals.

In the state of the FIG. 2, the primary circuit 31 does not need high oil pressure. This state according to FIG. 2 also corresponds to the fail-safe state that is adopted by the hydraulic feed device 1 in the event of a power outage. For example, for this purpose, the control valve 23 is preloaded by means of a return spring 44 into the end position shown in FIG. 2, which end position corresponds to a closed position. By means of the actuator 43, the control valve 23 can be displaced against the return force of the return spring 44 into the other end position shown in FIG. 3, which other end position corresponds to an open position.

In the state of the FIG. 2, the second port 37 in the control valve 23 is connected to the third port 38 so that finally the second pressure adjusting chamber 17 is connected to the reservoir 39. In this closed position, the first port 36 is advantageously blocked so as to avoid leakage through the control valve 23. In this closed position, the second pressure adjusting chamber 17 thus is separated from the pressure side 13. If the pressure on the pressure side 13 remains below the maximum pressure, the spring force 22 is predominant so that the maximum eccentricity 12 is set. If, in contrast, the pressure on the pressure side 13 in this state becomes higher than the maximum pressure, the pressure forces prevailing in the pressure adjusting chamber 16 become greater than the spring force 22, by which means the positioning element 14 is displaced, resulting in a decrease of the eccentricity 12. Consequently, the feed rate of the pendulum-slide cell pump 2 is reduced correspondingly as a result of which the pressure that can be generated therewith decreases correspondingly.

In the state of FIG. 3, the control valve 23 is in its open position in which the first port 36 is connected to the second port 37 while the third port 38 can be blocked. As a result, the pressure side 13 of the pendulum-slide cell pump 2 is connected to the second pressure adjusting chamber 17. Thus, pressure forces are also generated in the second pressure adjusting chamber 17, which pressure forces act against the spring device 20 and add to the pressure forces prevailing in the first pressure adjusting chamber 16. Overall, the spring force 22 of the spring device 20 can be overcome in this manner so that also in this case, displacing the positioning element 14 for reducing the eccentricity 12 and thus for reducing the pressure build-up on the pressure side 13 can be actively effected by means of the control device 33. A reduced feed rate or a reduced oil pressure is required in particular in such cases in which the primary circuit 31 does not need increased oil pressure for shifting the clutch. However, if the primary circuit 31 needs increased oil pressure temporarily or for a short time, the actuator 43 can be actuated via the control device 33 in such a manner that, for example, the end position shown in FIG. 2 is set for a short time and as a result, the maximum eccentricity 12 is set, as long as the pressure on the pressure side 13 does not exceed the maximum pressure.

Also, if the pressure on the pressure side 13 in the state shown in FIG. 3 exceeds the maximum pressure, a positioning movement driven by the first pressure adjusting chamber 16 takes place for the positioning element 14 resulting in a reduction of the eccentricity 12 so that the pressure limitation can also be ensured in this state.

It is clear that by means of the proportional valve 23 principally any intermediate positions between the two end positions shown in the FIGS. 2 and 3 can be set so that basically any pressure between the pressure of the pressure side 13 and the pressure of the pressure side 25 or the reservoir 39 can be set.

The invention claimed is:

1. A hydraulic system comprising:

a primary hydraulic circuit having a variable hydraulic pressure demand;

a secondary hydraulic circuit having a comparatively constant pressure demand in relation to the primary hydraulic circuit; and a hydraulic feed device connected to the primary hydraulic circuit and the secondary hydraulic circuit, the hydraulic feed device including:

a pendulum-slide cell pump having a pressure side configured to supply a feed pressure for the primary hydraulic circuit and the secondary hydraulic circuit, the pendulum-slide cell pump including a housing and an internal rotor drivingly connected to an external rotor via pendulum slides, the internal rotor rotatable about a rotation axis and the external rotor having a longitudinal center axis eccentric to the rotation axis;

a hydraulic positioning device including a positioning element mounting the external rotor and configured to change an eccentricity between the internal rotor and the external rotor, wherein the positioning element is mounted on the housing pivotably adjustable about a pivot axis arranged about an outer surface of the positioning element, the pivot axis disposed in a position that extends parallel and eccentric to the rotation axis of the internal rotor;

the positioning element preloaded by a spring device for setting a maximum eccentricity;

the hydraulic positioning device further including a first pressure adjusting chamber for adjusting the positioning element and a second pressure adjusting chamber for adjusting the positioning element;

wherein the first pressure adjusting chamber is pressurized and permanently hydraulically connected to the pressure side of the pendulum-slide cell pump to provide a force acting on the position element to hydraulically counteract the spring device;

wherein the second pressure adjusting chamber is pressurized via a proportional control valve and selectively hydraulically connected to the pressure side of the pendulum-slide cell pump acting on the positioning element to hydraulically counteract the spring device when the second pressure adjusting chamber is pressurized;

a control device coupled to the primary hydraulic circuit, the secondary hydraulic circuit, and the proportional control valve, wherein the control device selectively actuates the proportional control valve into one of a plurality of positions via control signals communicated to the proportional control valve, said control signals correlating with a respective hydraulic pressure demand of the primary hydraulic circuit to adjust the feed pressure and provide a necessary hydraulic pressure for both the primary hydraulic circuit and the secondary hydraulic circuit;

wherein the proportional control valve is selectively actuated via said control signals to adjust between the plurality of positions to vary the adjustable forces acting in the second pressure adjusting chamber and vary the eccentricity depending on the respective hydraulic pressure demand of the primary hydraulic circuit and the secondary hydraulic circuit when a pressure on the pressure side is below a predetermined maximum pressure, the plurality of positions of the proportional control valve including a first position where the second pressure adjusting chamber is hydraulically disconnected from the pressure side and the pendulum-slide cell pump supplies a first feed pressure, a second position where the second pressure adjusting chamber is hydraulically connected to the pressure side and the pendulum-slide cell pump supplies a second feed pressure less than the first feed pressure, and a third position intermediate to the first position and the second position where the pendulum-slide cell pump supplies a third feed pressure between the first feed pressure and the second feed pressure; and wherein the first pressure adjusting chamber is arranged proximal to the pivot axis, the second pressure adjusting chamber is arranged distal to the pivot axis, and the spring device is arranged distal to the pivot axis.

2. The system according to claim 1, wherein the control device reduces the feed pressure provided on the pressure side via said second pressure adjusting chamber by actuating the proportional control valve via said control signals into the second position in response to said control signals indicating a reduced hydraulic pressure demand for the primary hydraulic circuit.

3. The system according to claim 1, wherein the control device is coupled to a pressure sensor system that measures the hydraulic pressure provided by the hydraulic feed device.

4. The system according to claim 1, wherein the secondary circuit is connected to the hydraulic feed device via a volume flow control valve.

5. The system according to claim 1, wherein the primary circuit supplies oil to a hydraulic actuating device for actuating a clutch of a transmission while the secondary circuit supplies oil to lubrication points of the transmission.

6. The system according to claim 1, wherein the proportional control valve provides the third feed pressure in the third position by adjusting a pressure in the second pressure adjusting chamber to fall within a pressure interval between the pressure on the pressure side and a pressure on a suction side of the pump when the pump is operating and the pressure on the pressure side is below the predetermined maximum pressure.

7. The system according to claim 1, wherein the control device increases the feed pressure provided on the pressure side via the second pressure adjusting chamber by actuating the proportional control valve via said control signals in response to said control signals indicating a temporarily increased hydraulic pressure demand for the primary hydraulic circuit.

8. A hydraulic system, comprising:

at least two hydraulic circuits having a respective hydraulic pressure demand different from one another;

a hydraulic feed device for supplying hydraulic pressure to the at least two hydraulic circuits, the hydraulic feed device including:

a pendulum-slide cell pump having a pressure side coupled to the at least two hydraulic circuits and configured to output a feed pressure to said at least two hydraulic circuits at a necessary hydraulic pressure demand of the at least two hydraulic circuits, the pendulum-slide cell pump including an internal rotor drivingly connected to an external rotor via pendulum slides, the internal rotor rotatable about a rotation axis and the external rotor having a longitudinal center axis eccentric to the rotation axis;

a hydraulic positioning device for adjusting the feed pressure provided on the pressure side of the pendulum-slide cell pump, the hydraulic positioning device including a positioning element mounting the external rotor, the positioning element pivotably displaceable about a pivot axis arranged parallel and eccentric to the rotation axis for changing an eccentricity between the internal rotor and the external rotor;

the positioning element preloaded by a spring device for setting a maximum eccentricity;

the hydraulic positioning device further including a first pressure adjusting chamber for adjusting the positioning element, and a second pressure adjusting chamber for adjusting the positioning element;

the first pressure adjusting chamber permanently hydraulically connected to the pressure side of the pendulum-slide cell pump and pressurized to provide a force acting on the positioning element to hydraulically counteract the spring device;

the second pressure adjusting chamber controlled via a proportional control valve and selectively hydraulically connected to the pressure side of the pendulum-slide cell pump, the second pressure adjusting chamber selectively pressurized via the proportional control valve to provide an adjustable force acting on the positioning element to hydraulically counteract the spring device when the second pressure adjusting chamber is connected to the pressure side, wherein the proportional control valve is adjustable between a plurality of positions to change the adjustable force acting in the second pressure adjusting chamber and vary the eccentricity where each of the plurality of positions provides a different feed pressure on the pressure side of the pendulum-slide cell pump, the plurality of positions including at least a first position where the second pressure adjusting chamber is hydraulically separated from the pressure side, and a second position where the second pressure adjusting chamber is hydraulically connected to the pressure side;

a control device coupled to the at least two hydraulic circuits and the proportional control valve, wherein the control device selectively actuates the proportional control valve into one of said plurality of positions via control signals communicated to the proportional control valve, said control signals correlating with a respective hydraulic pressure demand of one of the at least two hydraulic circuits to adjust the feed pressure and provide the necessary hydraulic pressure for said at least two hydraulic circuits; and wherein the proportional control valve is actuated into one of the plurality of positions in response to said control signals to adjust the feed pressure provided on the pressure side of the pendulum-slide cell pump when the first pressure adjusting chamber and the second pressure adjusting chamber are pressurized with a pressure below a predetermined pressure.

9. The hydraulic system according to claim 8, wherein the first pressure adjusting chamber is pressurized and acts independent of the second pressure adjusting chamber to hydraulically displace the positioning element against a spring force of the spring device for reducing the eccentricity and reduce the feed pressure provided on the pressure side when the second pressure adjusting chamber is hydraulically disconnected from the pressure side and a pressure on the pressure side exceeds a predetermined maximum pressure.

10. The hydraulic system according to claim 8, wherein the proportional control valve is a 3-port/2-way directional control valve having a first port hydraulically connected to the pressure side of the pendulum-slide cell pump and a second port hydraulically connected to the second pressure adjusting chamber, and a third port hydraulically connected to a hydraulic reservoir.

11. The hydraulic system according to claim 10, wherein the first port is coupled to the second port to hydraulically connect the pressure side of the pendulum-slide cell pump to the second pressure adjusting chamber when the proportional control valve is in the second position, the second port is coupled to the third port to hydraulically connect the second pressure adjusting chamber to the hydraulic reservoir when the proportional control valve is in the second position, and wherein the intermediate position of the proportional control valve is configured to adjust a pressure in the second pressure adjusting chamber between the pressure on the pressure side and a pressure in the hydraulic reservoir when the pendulum-slide cell pump is operating.

12. The hydraulic system according to claim 8, wherein the proportional control valve includes an electrical actuator that can be activated via said control signals output from the control device.

13. The hydraulic system according to claim 8, wherein the positioning element is formed by a stator, the external rotor being rotatably arranged on the stator, the stator being arranged in a housing and pivotably displaced about the pivot axis that is parallel and eccentric to the rotational axis of the internal rotor with respect to a spring force of the spring device acting on the positioning element, wherein the rotational axis of the internal rotor is arranged stationary with regard to the housing.

14. The hydraulic system according to claim 13, wherein the first pressure adjusting chamber is directly bounded by a first inner wall portion of the housing and a first outer wall portion of the stator, wherein the second pressure adjusting chamber is directly bounded by a second inner wall portion of the housing and a second outer wall portion of the stator, and wherein the spring device has at least one compression spring via which the stator is supported by the housing.

15. The hydraulic system according to claim 8, wherein the at least two hydraulic circuits include a first hydraulic circuit having a variable hydraulic pressure demand, and a second circuit having a comparatively constant pressure demand in relation to the first circuit.

16. The hydraulic system according to claim 15, wherein the control device actuates the proportional control valve via said control signals to adjust the feed pressure provided on the pressure side as a function of need depending on the hydraulic pressure demand of the first circuit.

17. The hydraulic system according to claim 16, wherein the proportional control valve is actuated into the first position to increase the feed pressure provided on the pressure side in response to said control signals indicating a temporary increase of hydraulic pressure demand in the first hydraulic circuit.

18. The hydraulic system according to claim 16, wherein the proportional control valve is actuated into the second position to reduce the feed pressure provided on the pressure side in response to said control signals indicating a reduction of hydraulic pressure demand in the first hydraulic circuit.

19. The hydraulic system according to claim 8, wherein the proportional control valve is preloaded via a return spring into the first position where the second pressure adjusting chamber is separated from the pressure side.

* * * * *